US007782271B2

(12) United States Patent
Huang et al.

(10) Patent No.: US 7,782,271 B2
(45) Date of Patent: Aug. 24, 2010

(54) MULTI-FREQUENCY ANTENNA

(75) Inventors: Jiunn-Ming Huang, Taipei Hsien (TW); Feng-Chi Eddie Tsai, Taipei Hsien (TW); Pi-Hsi Cheng, Taipei Hsien (TW); Hen-An Chen, Taipei Hsien (TW); Yu-Chuan Su, Taipei Hsien (TW)

(73) Assignee: Wistron Neweb Corp, Taipei Hsien (TW)

( * ) Notice: Subject to any disclaimer, the term of this patent is extended or adjusted under 35 U.S.C. 154(b) by 376 days.

(21) Appl. No.: 11/826,240

(22) Filed: Jul. 13, 2007

(65) Prior Publication Data

US 2008/0231542 A1 Sep. 25, 2008

(30) Foreign Application Priority Data

Mar. 20, 2007 (TW) ..... 96109589 A

(51) Int. Cl.
*H01Q 1/36* (2006.01)

(52) U.S. Cl. ..... 343/895

(58) Field of Classification Search ..... 343/895, 343/866

See application file for complete search history.

(56) References Cited

U.S. PATENT DOCUMENTS 3,852,759 A * 12/1974 Felsenheld et al. ..... 343/729
4,494,117 A * 1/1985 Coleman ..... 342/365
5,317,327 A * 5/1994 Piole ..... 343/725
6,011,525 A * 1/2000 Piole ..... 343/895
6,184,845 B1 2/2001 Leisten et al.
6,611,691 B1 8/2003 Zhou et al.
7,262,738 B2 8/2007 Ho et al.

FOREIGN PATENT DOCUMENTS

TW 2006 10227 3/2006

* cited by examiner

*Primary Examiner*—Tho G Phan
(74) *Attorney, Agent, or Firm*—Bacon & Thomas, PLLC

(57) ABSTRACT

A portable electronic device with function of receiving and radiating radio frequency (RF) signal and a multi-frequency antenna thereof are disclosed. The portable electronic device comprises a RF module and a multi-frequency antenna connecting to the RF module. The multi-frequency antenna comprises a helix element and a coaxial cable disposed within the helix element. The helix element comprises a first helix portion and a second helix portion adjacent to each other, and the coaxial cable comprises a grounding portion and a radiating portion. The first helix portion covers the grounding portion, and the radiating portion is disposed within the second helix portion separated with each other.

7 Claims, 19 Drawing Sheets

MULTI-FREQUENCY ANTENNA

BACKGROUND OF THE INVENTION

1. Field of the Invention

The present invention relates to an antenna, and more particularly, to a multi-frequency antenna.

2. Description of the Related Art

With the evolution of wireless communication technology, various portable devices are exploiting wireless communication technology for data transmission, thus causing the antenna design to evolve at a rapid rate. Nowadays, these portable communication devices are becoming lighter and smaller, and the antenna must also be reduced in size in order to be installed into these electronic devices.

In terms of antenna's exterior design, the lengthy external antenna that is designed to receive and transmit radio frequency has become shorter and has been internalized, and it makes the appearance of the devices more appealing. In terms of application aspect, antenna is able to take on different shapes and sizes, thus the antennas can be designed accordingly to comply with various electronic appliance standards and to cater for different system products. Therefore, antenna manufacturing has the characteristic of high variety with low volume. However, the basic objective of designing an antenna is to improve the quality of signal transmission and reception, thus this property should not be compromised from improving its exterior appearance, size or choice of material.

Nowadays, the helical antenna and the monopole antenna are used in the circuit separately, and its pitfall is that both the helical antenna and the monopole antenna can only have a single-band frequency respectively. The applicant of the present invention has filed a TW patent application with Appl. No.: 095141199 on Dec. 7, 2006, which discloses a multi-frequency antenna combining with helix element and/or radiating element. The multi-frequency antenna comprises a helix element connecting to a feeding portion and a helix element connecting to a grounding portion. The radiating element is resonated with high frequency such as 5 GHz, and the helix element is resonated with low frequency such as 2.4 GHz. However, the multi-frequency antenna of the TW application No. 095141199 further comprises a base for fixing the radiating element and the helix element, and further for grounding and feeding.

SUMMARY OF THE INVENTION

In order to cater for the aforementioned needs in the precedent technology, the present invention provides an antenna that can be used for the transmission and reception of radio frequency (RF) signals.

The multi-frequency antenna of the present invention comprises a helix element and a coaxial cable. The coaxial cable is disposed within the helix element. The helix element comprises a first helix portion and a second helix portion adjacent to each other. The coaxial cable comprises a grounding portion and a radiating portion. The first helix portion covers the grounding portion. The first helix portion is connected with the grounding portion. For example, the first helix portion and the grounding portion are connected by soldering therebetween. In this embodiment, the radiating portion is disposed within the second helix portion. The radiating portion and the second helix portion are separated.

The radiating portion comprises an isolating layer and a core covered by the isolating layer. The grounding portion comprises a metal layer covering the isolating layer. The coaxial cable comprises an insulating layer covering the metal layer. The length of the radiating portion is around ¼ wavelength, such as ¼ wavelength of the high frequency (5 GHz).

A dielectric portion may be disposed between at least a part of the radiating portion and at least a part of the second helix portion to avoid improper interference. The dielectric portion may be insulating, such as formed by low dielectric material comprising sponge, acrylic fiber, plastic, or ceramic.

In one embodiment, the multi-frequency antenna further comprises a grounding element comprising a covering portion. The first helix portion substantially covers the metal layer. The covering portion of the grounding element covers the first helix portion so as to ground the grounding portion and the first helix portion simultaneously.

The second helix portion of the present invention may have different variation according to different fields or frequency. For example, the cross-section of the second helix portion may be circular, square, oval, triangular, or polyhedron. The helix element controls low frequency, so the length of the second helix portion is ¼ wavelength (i.e. calculated by stretching and measuring it from the grounding portion to its end), such as ¼ wavelength of low frequency of 2.4 GHz. In another ward, the height of the second helix portion 112 is about 0.08~0.12 wavelength before stretching.

In one of the other embodiments, the multi-frequency antenna comprises a helix element and a coaxial cable as described above, however one end of a radiating portion and one end of a second helix portion are connected with each other, such as by soldering the two ends. The multi-frequency antenna in this embodiment generates a spiral route before grounding to reduce the total size of the whole antenna. That is, in this embodiment, the resonance frequency may be adjustable based on the lengths of the radiating portion and the second helix portion in order to obtain a desired frequency range.

In one of another embodiment, the second helix portion may further comprise a connecting portion surrounding the end of the radiating portion so as to connect the end of the second helix portion. Alternatively, the end of the second helix portion may be formed as perpendicular.

In another aspect of the present invention, a multi-frequency antenna comprising a helix element and a coaxial cable is disclosed, wherein the helix element comprises a first helix portion and a radiator adjacent to each other. The grounding portion and the first helix portion are connected with each other.

The radiator of the helix element comprises a plurality of bends forming a plurality of sections. In a preferred embodiment, a grounding element comprising a covering portion can be used for covering the first helix portion and a supporting portion used for covering one of the sections.

The radiator may comprise a feeding point shaped in a loop so that no post-processing is required.

Various frequencies can be generated through the antenna disclosed in the present invention to cover a wide range of bandwidths for the system requirements. The antenna of the present invention has high practical industrial value as it is simple to design and it also leads to low manufacturing cost.

DETAILED DESCRIPTION OF THE PREFERRED EMBODIMENT

The advantages and innovative features of the invention will become more apparent from the following detailed description when taken in conjunction with the accompanying drawings.

Figure 1A:
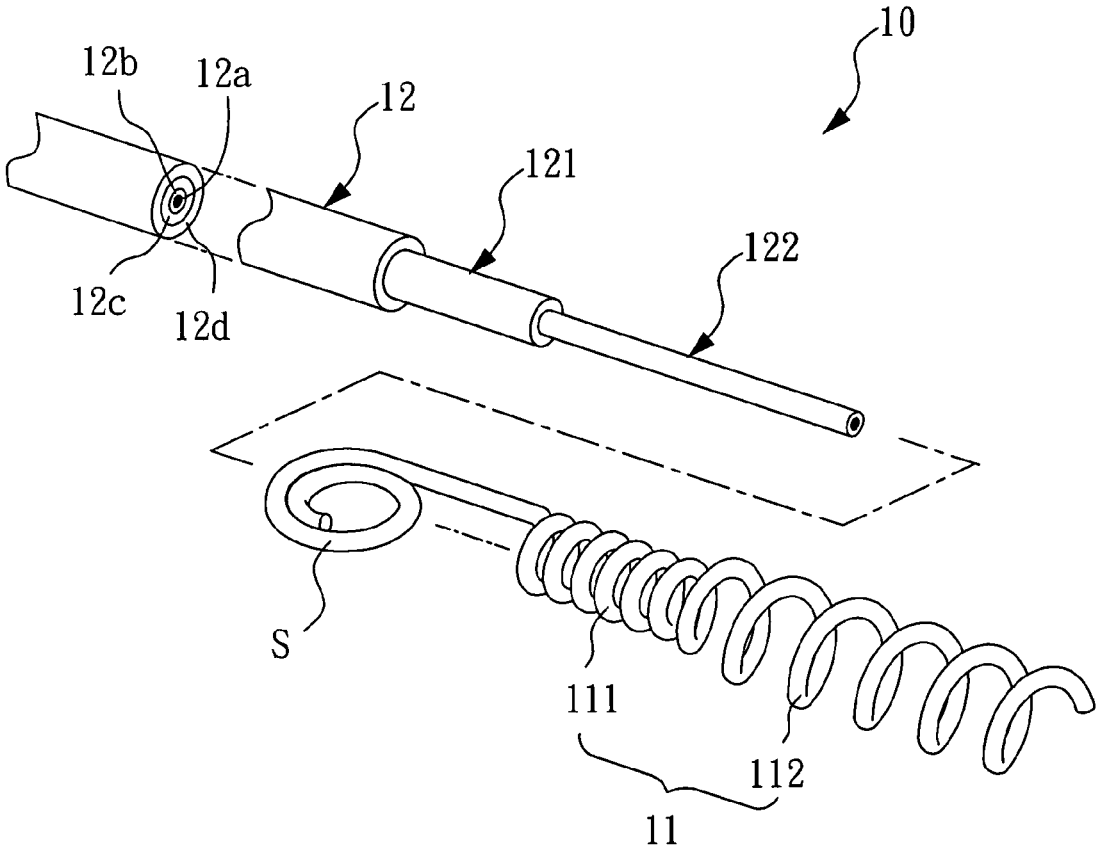
FIG. 1A is a perspective diagram showing a multi-frequency antenna for one of embodiments of the present invention.

Please refer to FIG. 1A. The present invention provides a multi-frequency antenna 10 comprising a helix element 11 and a coaxial cable 12. The helix element 11 comprises a first helix portion 111 and a second helix portion 112 adjacent to each other. The coaxial cable 12 comprises a grounding portion 121 and a radiating portion 122.

Figure 1B:
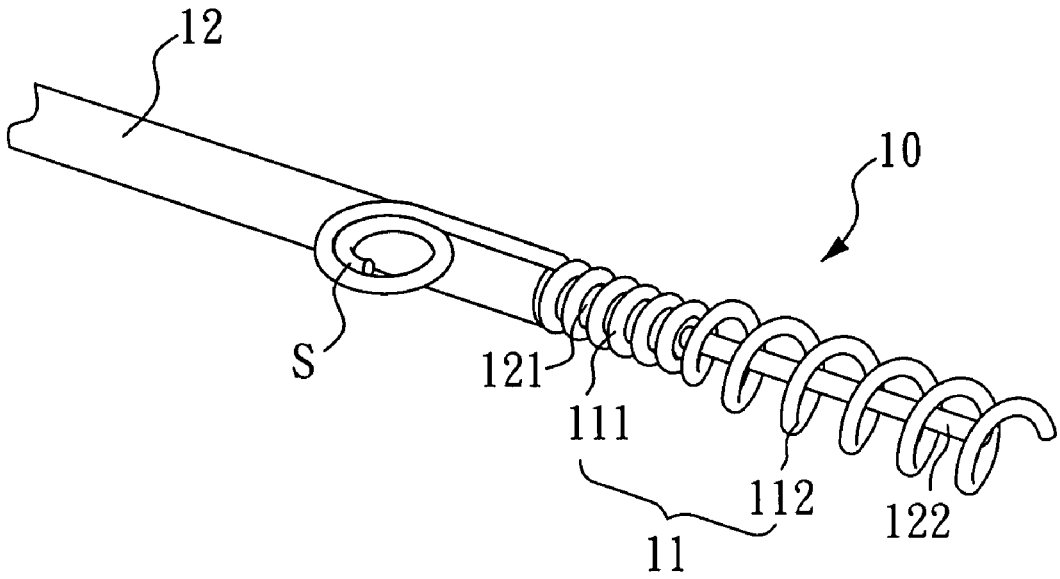
FIG. 1B is a perspective diagram according to FIG. 1A.

Referring to FIG. 1A and FIG. 1B, the first helix portion 111 covers the grounding portion 121. The radiating portion 122 is disposed within the second helix portion 112. The grounding portion 121 and the first helix portion 111 are connected with each other such as by soldering to connect the grounding portion 121 and the first helix portion 111, wherein the radiating portion 122 and the second helix portion 112 are separated with each other. In this embodiment of the present invention, the helix diameter of the second helix portion 112 is greater than the first helix portion 111.

Please refer back to FIG. 1A. It is preferably that the coaxial cable 12 comprises a core 12*a*, an isolating layer 12*b*, a metal layer 12*c*, and an insulating layer 12*d*. The isolating layer 12*b* covers the core 12*a*. The metal layer 12*c* covers the isolating layer 12*b*. The insulating layer 12*d* covers the metal layer 12*c*. In this embodiment, the radiating portion 122 comprises the isolating layer 12*b* and the core 12*a*. For example, removing the metal layer 12*c* and the insulating layer 12*d* of the coaxial cable 12 can expose the radiating portion 122. The grounding portion 121 comprises the metal layer 12*c*, the isolating layer 12*b*, and the core 12*a*. For example, removing the insulating layer 12*d* of the coaxial cable 12 can expose the grounding portion 121. The metal layer 12*c* covers the isolating layer 12*b*. The length of the radiating portion can be ¼ wavelength, such as ¼ wavelength of high frequency (ex. 5 GHz).

The length of the second helix portion 112, i.e. calculated by stretching and measuring it from the grounding portion to its end, is substantially around ¼ wavelength. For example, the length can be ¼ wavelength of low frequency (such as 2.4 GHz). In another word, the height of the second helix portion 112 is about 0.08~0.12 wavelength before stretching.

Figure 1C:
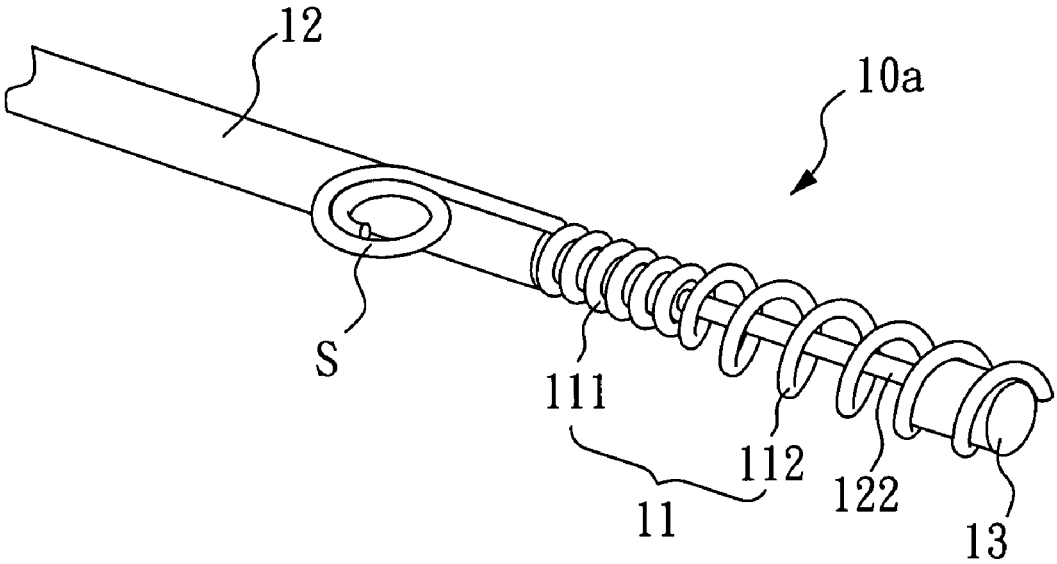
FIG. 1C is a perspective diagram showing a multi-frequency antenna with a dielectric portion for another embodiment of the present invention.

Referring to FIG. 1C, in one embodiment, a multi-frequency antenna 10*a* comprises a dielectric portion 13. The dielectric portion 13 is disposed between at least a part of the radiating portion 122 and at least a part of the second helix portion 112 so as to separate the radiating portion 122 and the second helix portion 112 for avoiding improper interference. The dielectric portion 13 is insulating, which can be formed by, for example, low constant dielectric material comprising sponge, acrylic fiber, plastic, or ceramic.

In general, the multi-frequency antenna 10 or 10*a* is assembled into an electronic device (will be described in below). A fixing portion S can be used to screw (or solder) the multi-frequency antenna 10 or 10*a* into (or onto) the electronic device so as to ground the grounding portion 121 and the first helix portion 111 simultaneously.

However, when the housing of the electronic device is not made by conductive material, the fixing portion S cannot provide grounding function for the grounding portion 121 and the first helix portion 111. Please refer to FIG. 2A. In another embodiment, a multi-frequency antenna 10*b* comprises a grounding element 14 to ground the grounding portion 121 and the first helix portion 111 simultaneously. The grounding element 14 comprises a covering portion 141 covers the first helix portion 111 of the helix element 11 so as to ground the grounding portion 121 and the first helix portion 111 simultaneously.

Figure 2A:
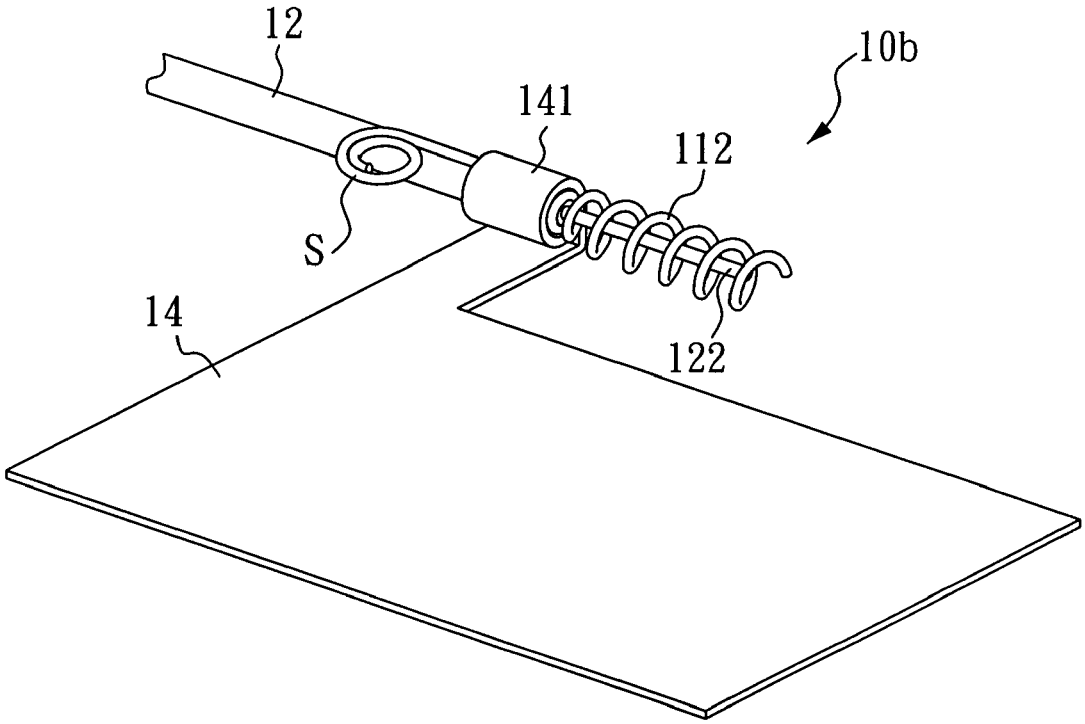
FIG. 2A is a perspective diagram showing a multi-frequency antenna with a grounding element for yet another embodiment of the present invention.
Figure 2B:
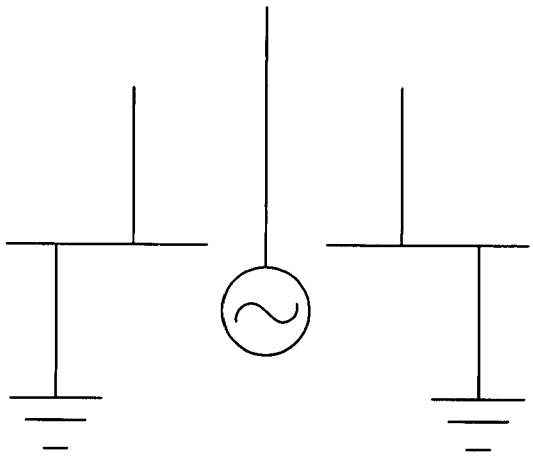
FIG. 2B is an equivalent circuit diagram according to the multi-frequency antenna of FIG. 2A.

FIG. 2B shows an equivalent circuit diagram according to the embodiment of FIG. 2A, which ground on both sides. That is, the coaxial cable 12 and the helix element 11 both are grounded.

Figure 3A:
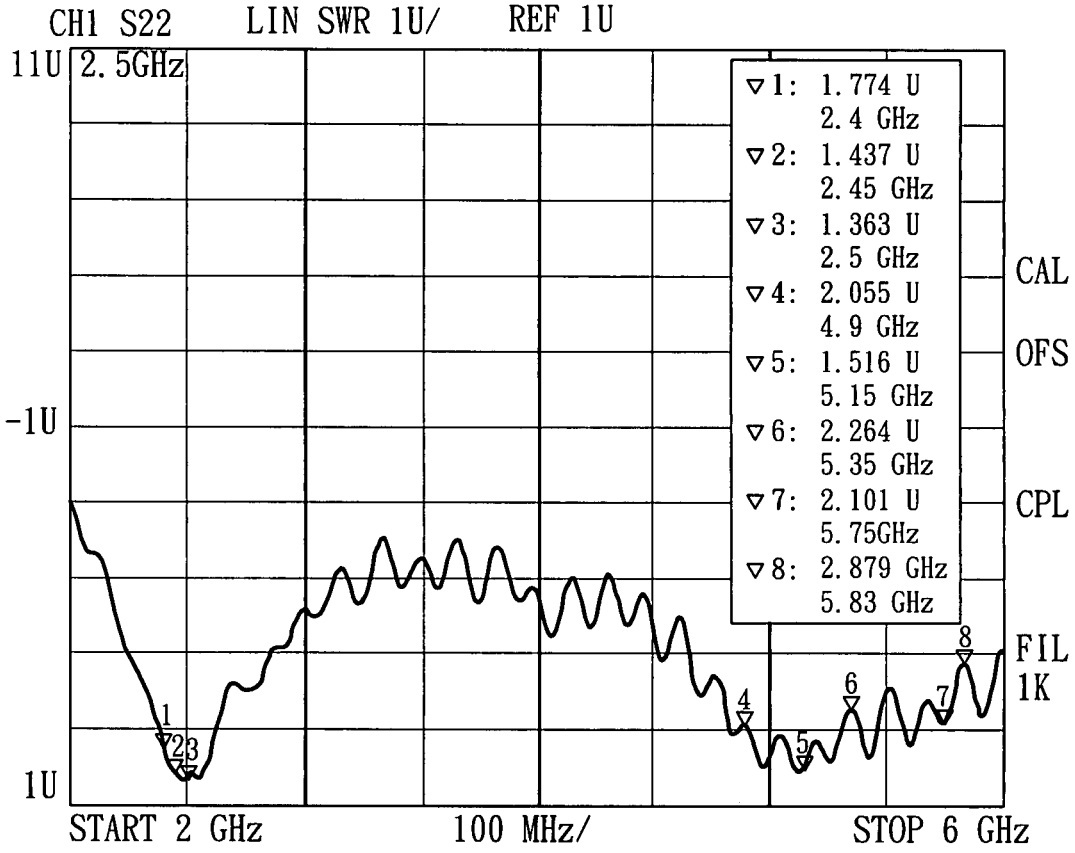
FIG. 3A is a Voltage Standing Wave Ratio (VSWR) diagram for the embodiment in accordance with FIG. 2A.
Figure 3B:
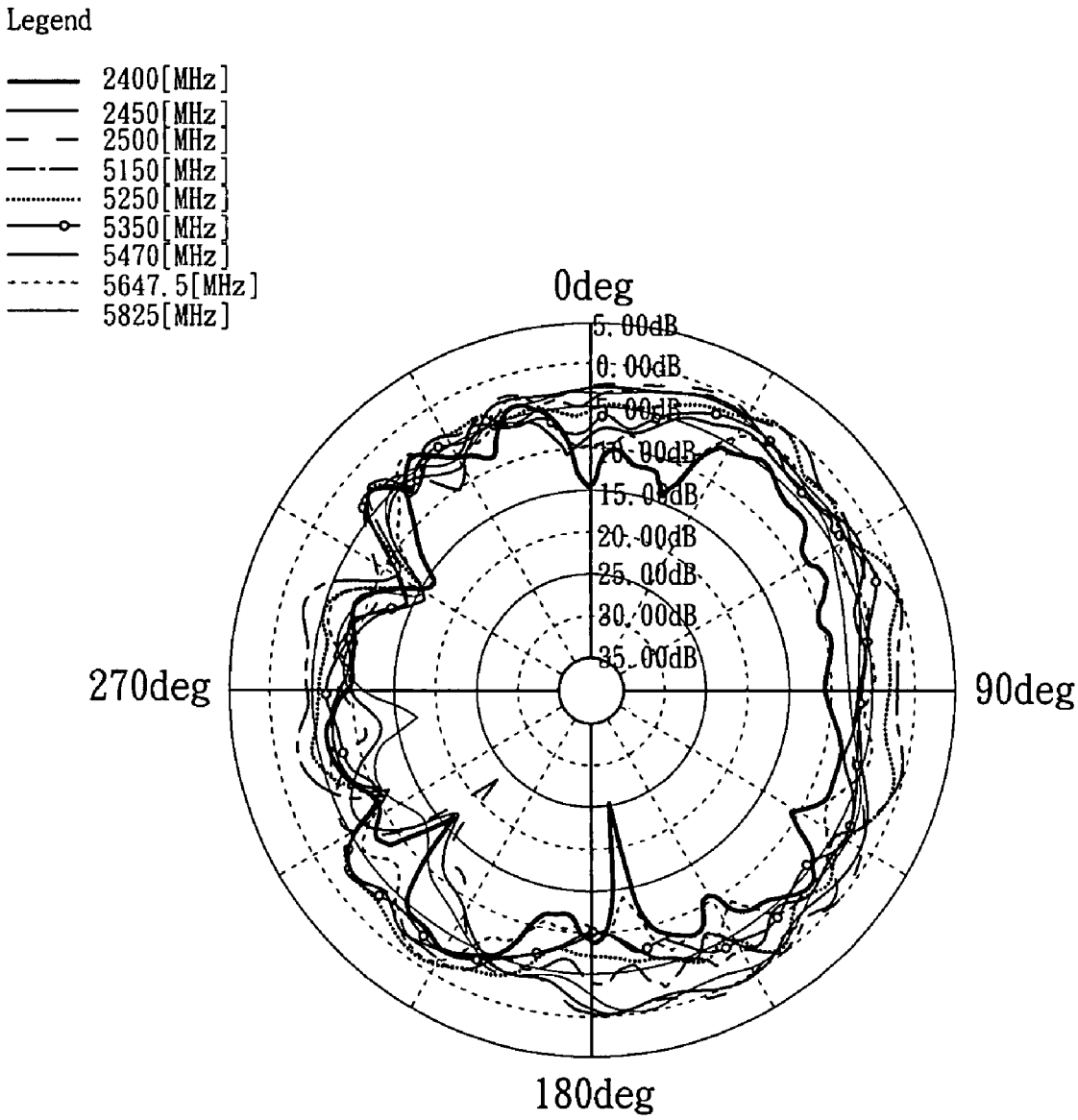
FIG. 3B is a radiation pattern with elevational plane (XY plane) according to multi-frequency antenna of FIG. 1B.

Furthermore, referring to FIG. 3A, a Voltage Standing Wave Ratio (VSWR) diagram for the embodiment in accordance with FIG. 2A is shown. As shown in FIG. 3A, it is apparent that the outstanding Voltage Standing Wave Ratio (VSWR) can be obtained under both high and low frequencies (such as 2 GHz and 5 GHz). A radiation pattern with elevational plane (XY plane) according to the multi-frequency antenna of FIG. 1B is shown in FIG. 3B.

Figure 4A:
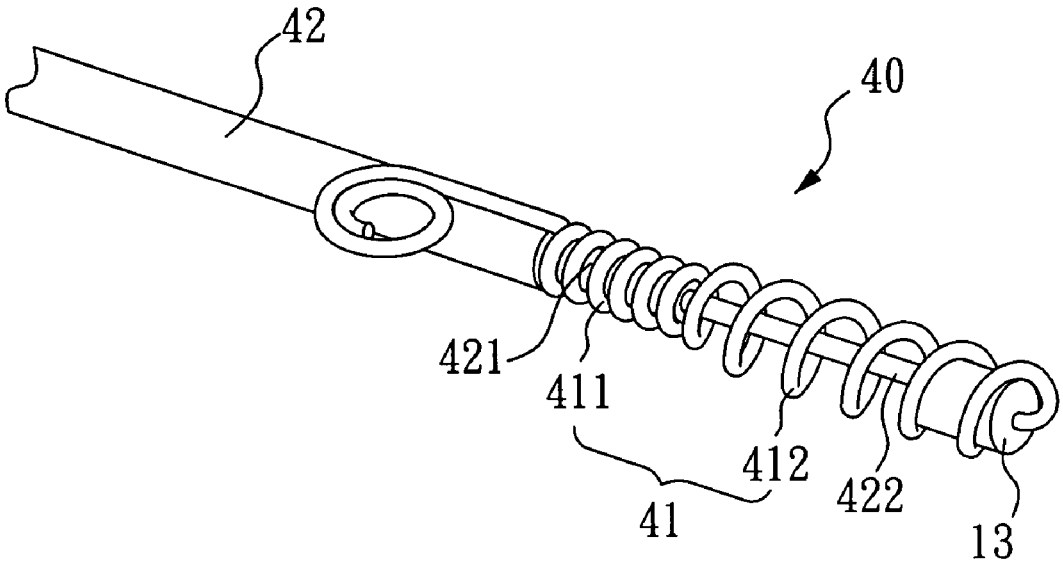
FIG. 4A is a perspective diagram showing a multi-frequency antenna for the other one of embodiments of the present invention.

Another embodiment of a multi-frequency antenna of the present invention is shown in FIG. 4A. The multi-frequency antenna 40 comprises a helix element 41 and a coaxial cable 42. The helix element 41 comprises a first helix portion 411 and a second helix portion 412 those are adjacent to each other. The coaxial cable 42 is disposed within the helix element 41. The coaxial cable 42 comprises a grounding portion 421 and a radiating portion 422. The first helix portion 411 covers the grounding portion 421. The grounding portion 421 is connected with the first helix portion 411, for example by soldering to connect each other. One end of the radiating portion 422 is connected with one end of the second helix portion 412. For example, the end of the second helix portion 412 can be bended to connect with the end of the radiating portion 422 by soldering.

Similarly, in this embodiment, a dielectric portion 13 can be used to separate the radiating portion 422 and second helix portion 412. In addition, though it does not show in the figures, the multi-frequency antenna 40 comprises a grounding element for grounding the grounding portion 121 and the first helix portion 111 simultaneously.

Figure 4B:
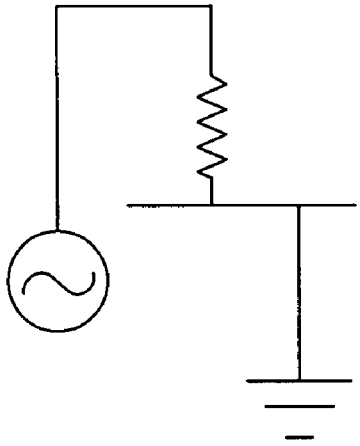
FIG. 4B is an equivalent circuit diagram according to the multi-frequency antenna of FIG. 4A.

FIG. 4B shows an equivalent circuit diagram according to the multi-frequency antenna of FIG. 4A. It shows that before grounding, it can have a loop so as to reduce the size of the multi-frequency antenna 40.

Figure 5:
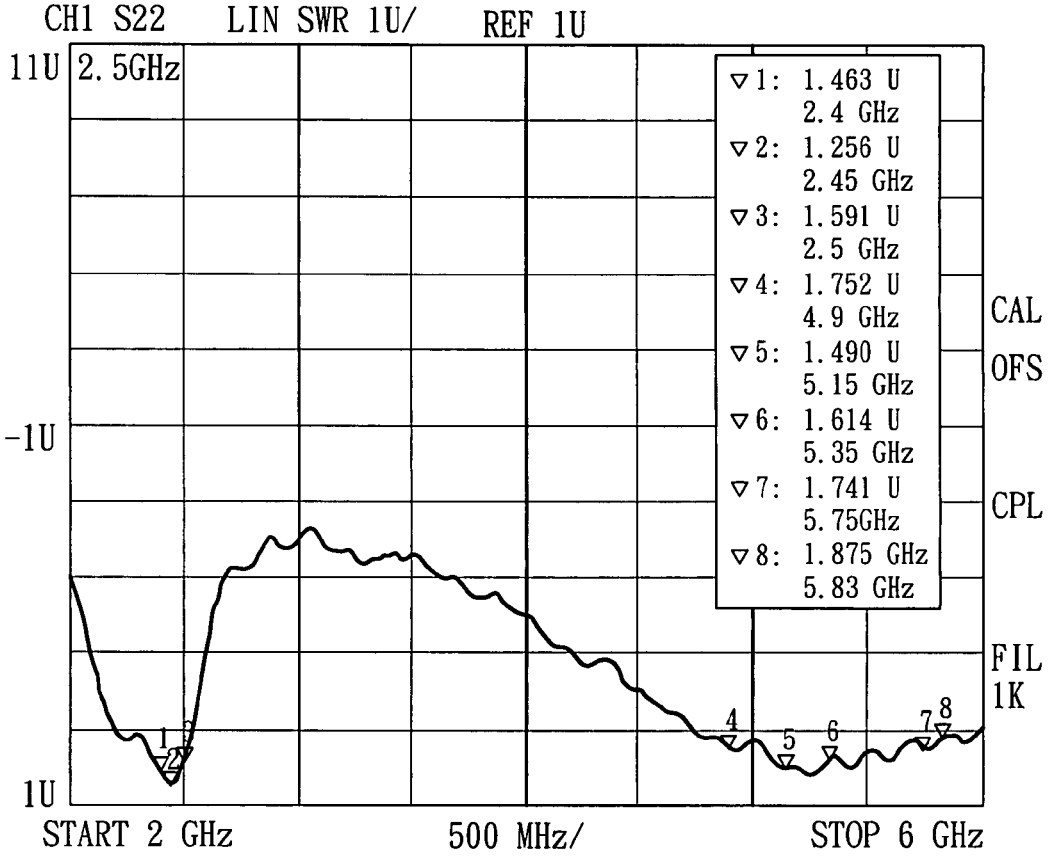
FIG. 5 is a VSWR diagram for the embodiment in accordance with FIG. 4A.

FIG. 5 is a VSWR diagram for the embodiment in accordance with FIG. 4A. As shown in FIG. 5, it is apparent that the outstanding Voltage Standing Wave Ratio (VSWR) can be obtained under both high and low frequencies (such as 2 GHz and 5 GHz).

Figure 6A:
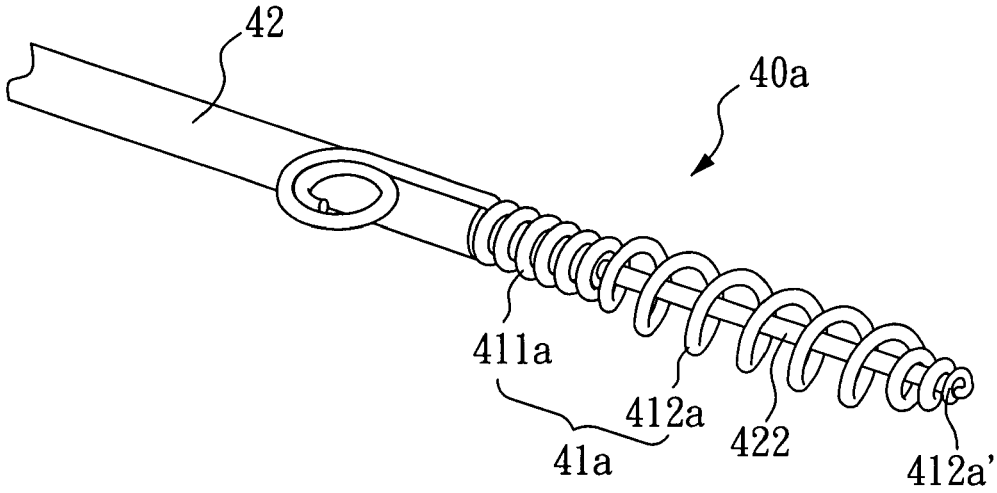
FIG. 6A and FIG. 6B are perspective diagrams showing two different multi-frequency antennas for different embodiments of the present invention.

To connect the end of the radiating portion 422 and the end of the second helix portion 412, except using soldering, it can have the end of the second helix portion 412 to wind around the radiating portion 422. Referring to FIG. 6A, the second helix portion 412*a* further comprises a connecting portion 412*a*'. The connecting portion 412*a*' winds around the end of the radiating portion 422 so as to connect the radiating portion 422 and the end of the second helix portion 412*a*.

Figure 6B:
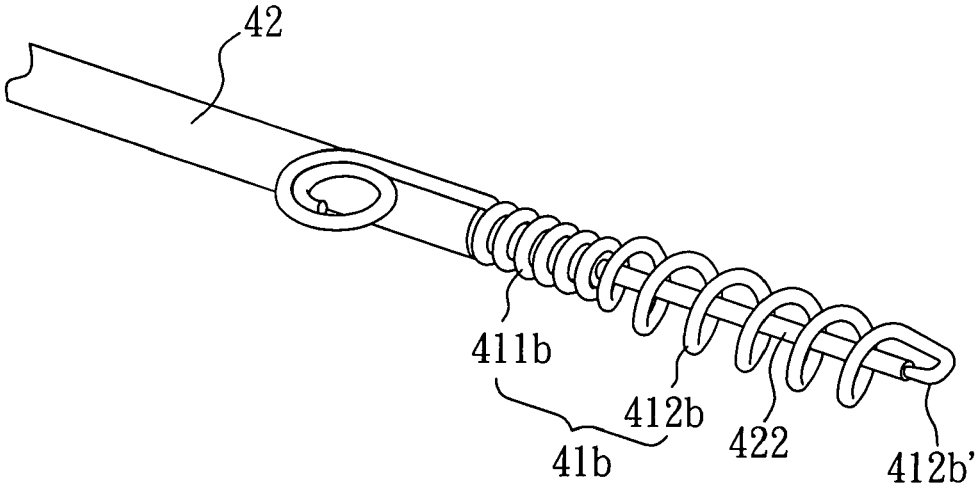
Figure 6C:
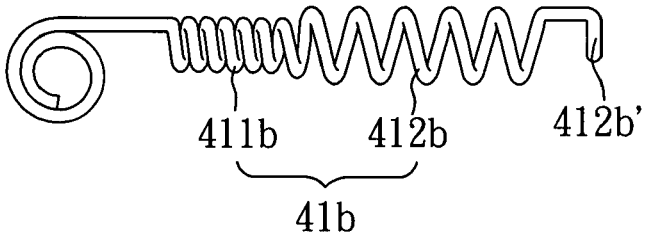
FIG. 6C is a top view of a helix element showing in FIG. 6B.

Alternatively, referring to FIG. 6B, the second helix portion 412*b* can also use a special structure to enhance the connection between the helix element 41*b* and the coaxial cable 42. For example, referring to the helix element 41*b* of FIG. 6C, the end 412*b*' of the second helix portion 412*b*. The end 412*b*' can be formed as perpendicular, thus the connection between the end 412*b*' of the second helix portion 412*b* and the radiating portion 422 of the coaxial cable 42 the can be more enhanced for the connection between the helix element 41*b* and the coaxial cable 42. Further, the production process of the helix element 41*b* can be easier.

Figure 7A:
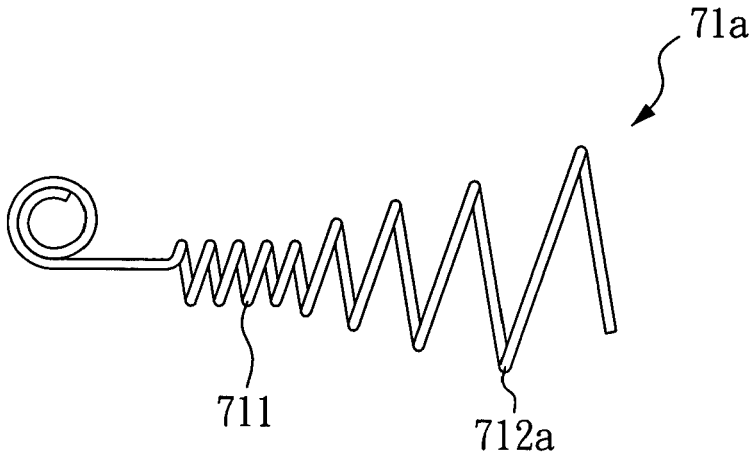
FIG. 7A-FIG. 7C are top views of different helix elements for different embodiments.
Figure 7B:
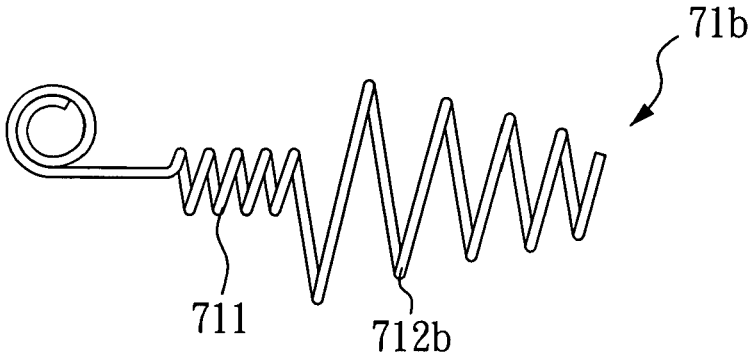
Figure 7C:
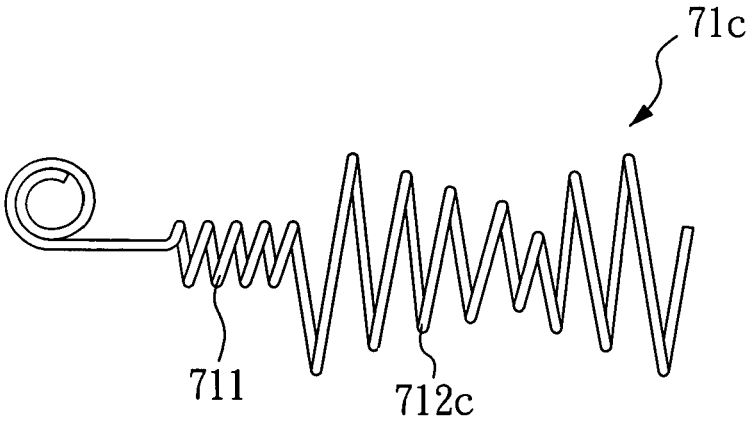

In addition, the helix element of the multi-frequency antenna 10, 10*a*, 10*b*, 40, or 40*a* according to the figures herewith, though they all have the same diameter in their second helix portion, they may have variation. Please refer to FIG. 7A-7C. The second helix portion 712*a*, 712*b*, or 712*c* of the helix element 71*a*, 71*b*, or 71*c* may vary the diameter thereof. For example, the diameter can be varied from small to big or from big to small, or any combination thereof.

Figure 8A:
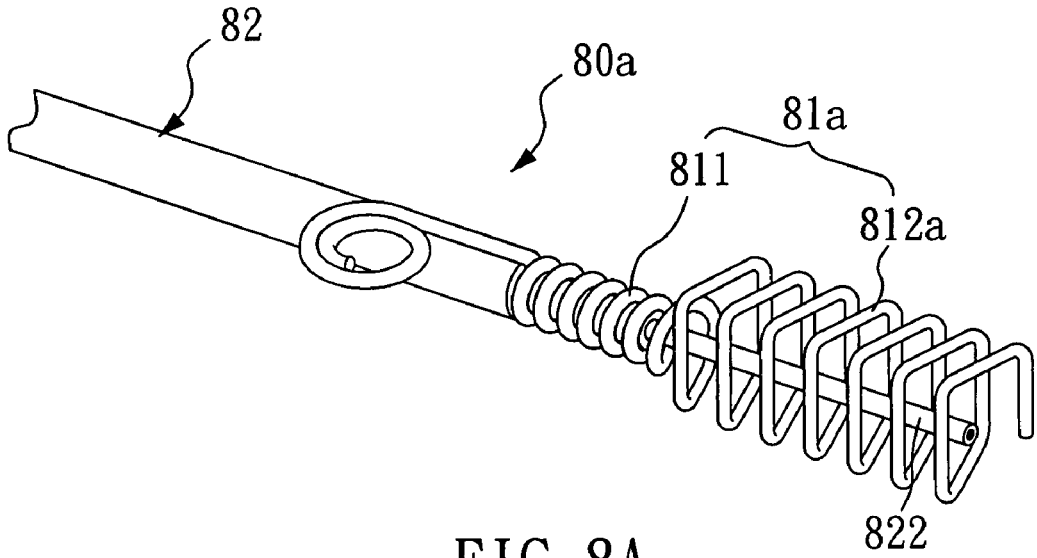
FIG. 8A and FIG. 8B are perspective diagrams showing two different multi-frequency antennas with different helix elements for different embodiments of the present invention.
Figure 8B:
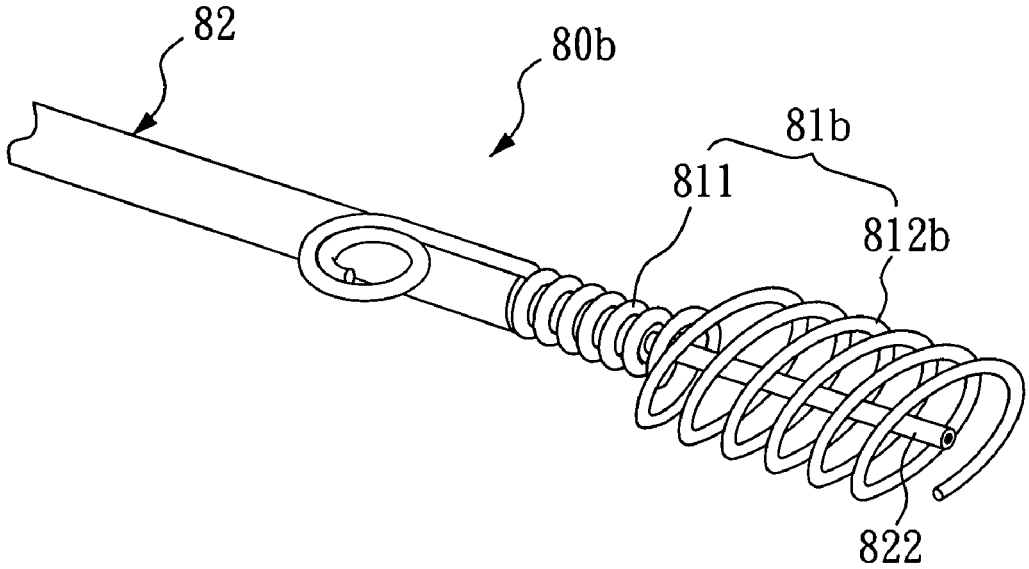

Furthermore, the helix element of the multi-frequency antenna 10, 10*a*, 10*b*, 40, or 40*a* according to the figures herewith, though they all are shaped in circular, which are not used to limit the present invention. The helix element according to the present invention may vary based on different fields or frequency requirements. For example, referring to FIG. 8A and FIG. 8B, the second helix portion 812*a*, 812*b* of the helix element 81*a*, 81*b* shows in shape of square and oval respectively. Furthermore, the cross-sectional area of the helix element may be circular, square, oval, triangular, polyhedron or other shapes alike (not shown in the figure). Essentially, as long as the pillar object is in the shape of cylindrical, a cone, a rectangular, an oval, a triangular or a polyhedron, then a metal strip can be used to wind around the pillar object to construct the helix element into different shapes, so it will not be explained further.

In different embodiments of the present invention, the diameter of the helix element 11, 41, 41*a*, 71*a*, 71*b*, 71*c*, 81*a*, or 81*b* can be substantially around 0.2-1.5 mm. The diameter of the second helix portion is substantially around 4.5±0.5 mm. The distance between every two helixes of the second helix portion may be substantially around 2.8±0.5 mm.

In summary, the helix element of the present invention uses the resonance frequency (e.g. high frequency) generated from the radiating portion to radiate the helix element by coupling energy, so as to generate another form of resonance frequency (e.g. low frequency). Therefore, the radiated mode can provide a wide frequency band for different system. Various frequencies can be generated through this kind of antenna to cover a wide range of bandwidths for the system requirements. The antenna of the present invention has high practical industrial value as it is simple to design and it also leads to low manufacturing cost.

Figure 9:
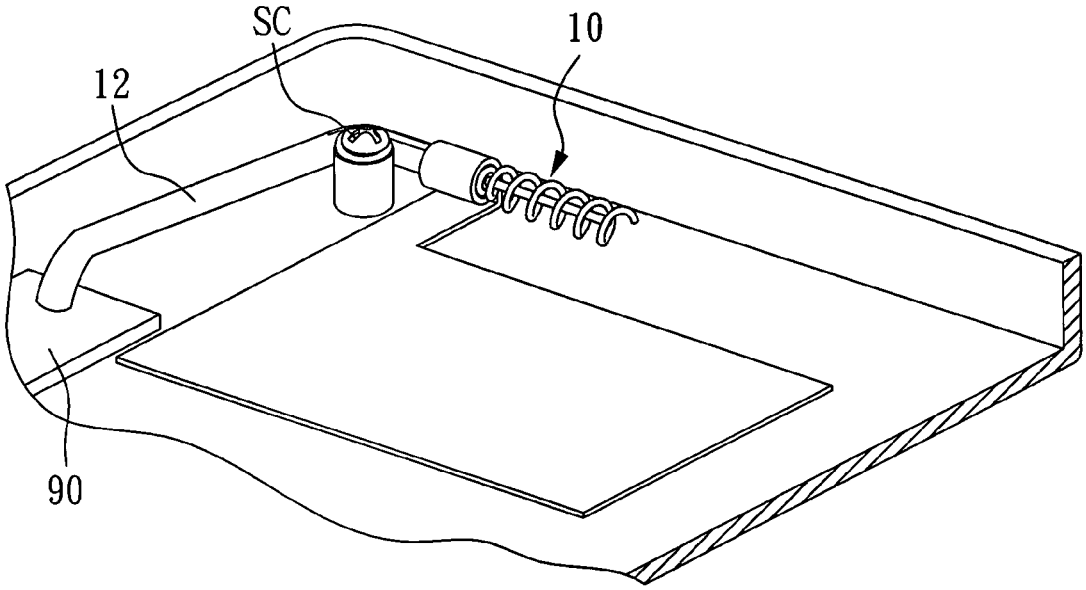
FIG. 9 is a part view of a portable electronic device showing a multi-frequency antenna and a radio frequency (RF) module therein.
Figure 10A:
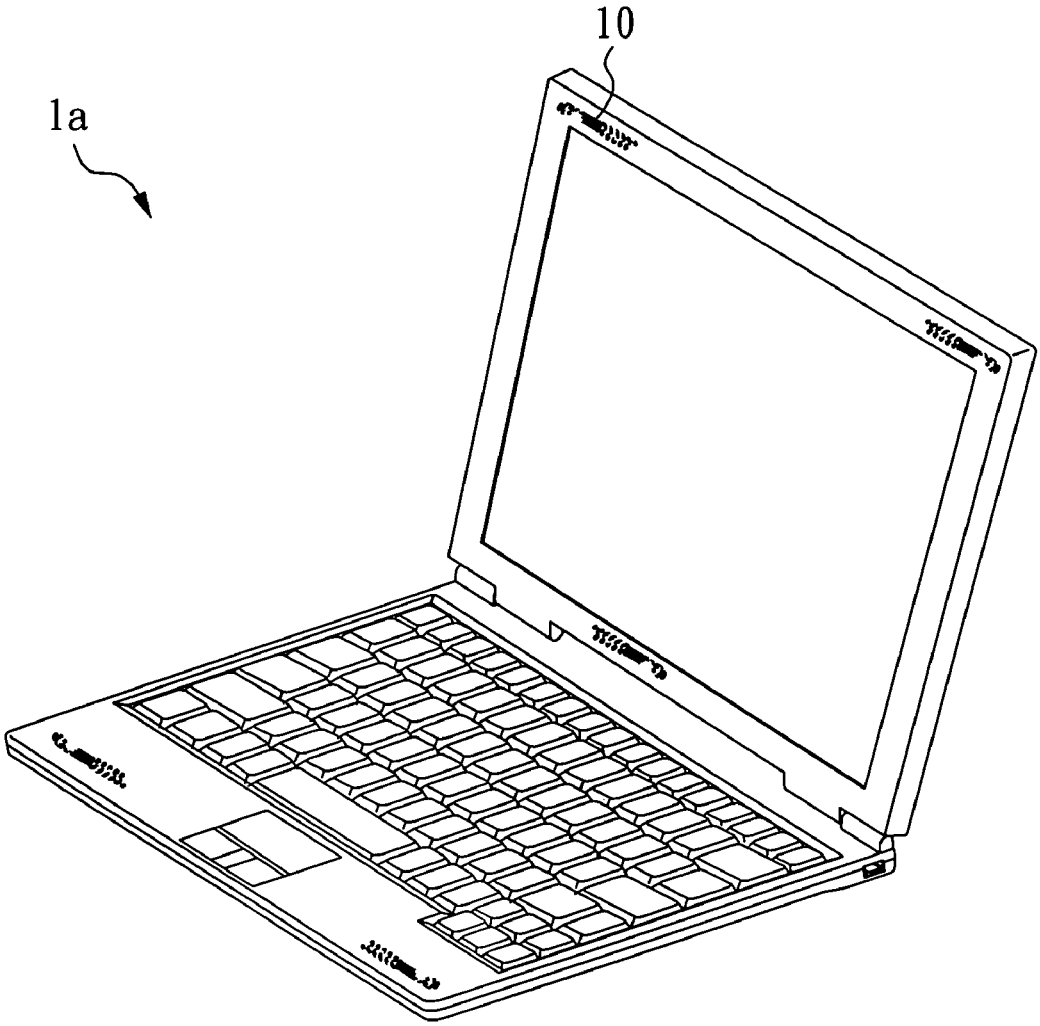
FIG. 10A and FIG. 10B are perspective diagrams showing a portable electronic device with a multi-frequency antenna thereon.
Figure 10B:
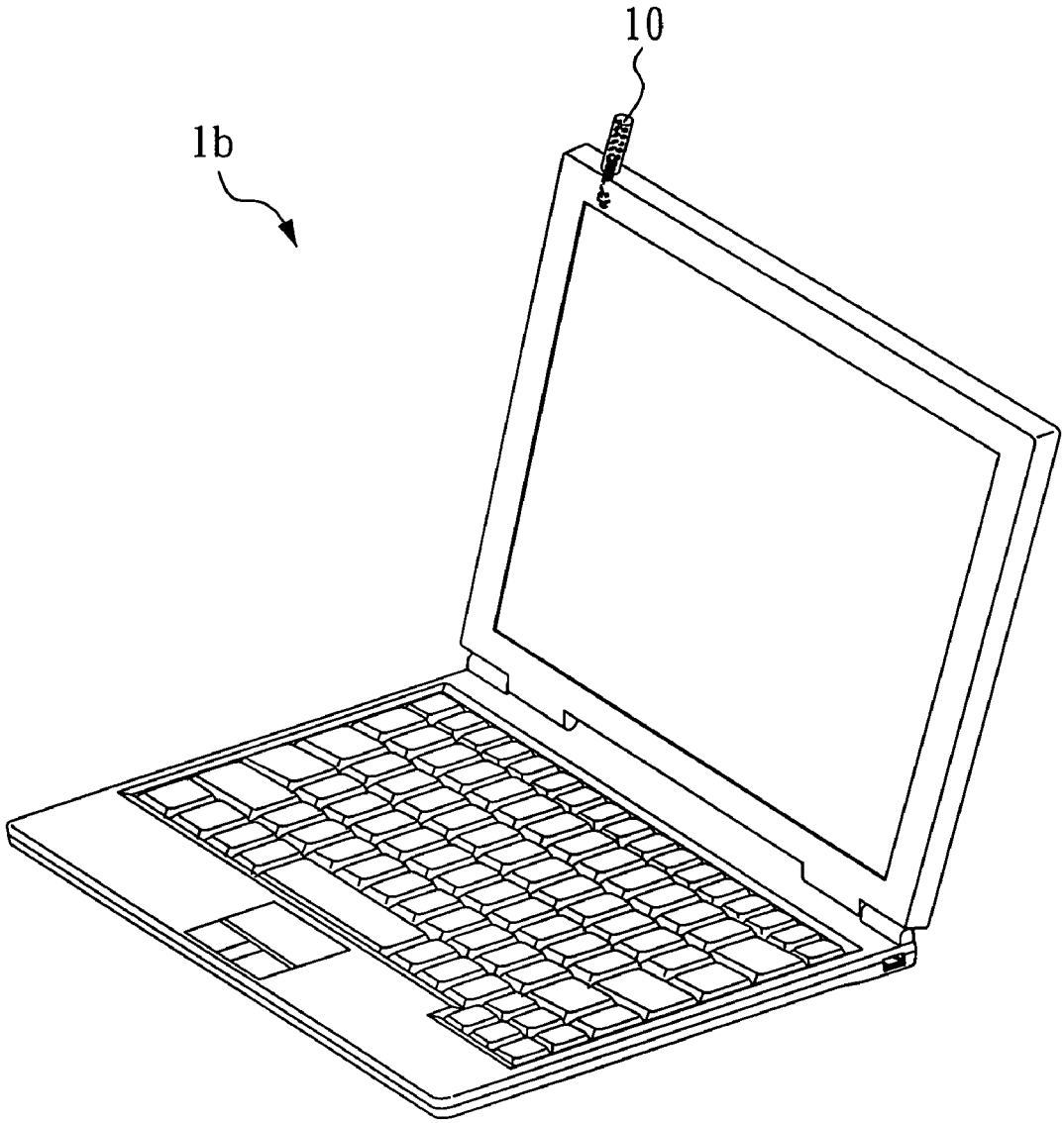

In FIG. 9, a portable electronic device is disclosed with using an antenna of the present invention, wherein the portable electronic device can be a laptop (as shown in FIGS. 10A and 10B), a personal digital assistance (PDA; not shown), or a cell phone (not shown). As shown in FIG. 9, the portable electronic device comprises a radio frequency (RF) module 90 and a multi-frequency antenna (such as the multi-frequency antenna 10, 10*a*, 10*b*, 40, 40*a*, 80*a*, or 80*b* as described above). In order to simplify the discussion, only the multi-frequency antenna 10 and the laptop 1*a*, 1*b* will be used to represent others in below description.

The multi-frequency antenna 10 and the RF module 90 are connected electronically. For example, a coaxial cable 12 can be used to connect the multi-frequency antenna 10 and the RF module 90 electronically. As shown in FIG. 9, the multi-frequency antenna 10 can be screwed (or soldered) on the housing of the portable electronic device. Thus, if the housing of the portable electronic device is made by high dielectric material, the multi-frequency antenna 10 can be grounded without having the grounding element as described above. But if the housing of the portable electronic device is made by low dielectric material, the multi-frequency antenna 10 may further comprise the grounding element (as the grounding element 14 shown in FIG. 2A) for grounding.

Please refer to FIGS. 10A and 10B. The multi-frequency antenna 10 can be disposed in horizontal or vertical at any corner or places of the portable electronic device. The portable electronic device (such as laptop 1*a* or 1*b*) comprises the multi-frequency antenna 10, so it may have the function of transmitting or receiving RF signal via the multi-frequency antenna 10. The location of the multi-frequency antenna 10 to be disposed is not limited to the figures. The location of the multi-frequency antenna 10 to be disposed may be varied according to different design requirements of the portable electronic device.

In addition to the helix element 11, 41, 41*a*, 41*b*, 71*a*, 71*b*, 71*c*, 81*a*, and 81*b* described in above, the present invention can be varied with different second helix portion. Please refer to FIGS. 11A and 11B. A multi-frequency antenna 9 comprises a helix element 91 and a coaxial cable 12 disposed within the helix element 91. The helix element 91 comprises a first helix portion 911 and a radiator 912 instead of a second helix portion. The coaxial cable 12 comprises a grounding portion 121 being covered by the first helix portion. The grounding portion 121 and the first helix portion 911 are connected with each other.

The radiator 912 comprises a plurality of bends forming a plurality of sections 912*a*, 912*b*, 912*c*, and 912*d*. The length of the radiator 912 away from the feeding point F can determine the low-band resonances (such as 2.4 GHz). The feeding point F can be shaped for easier soldering, for example, with a pressed wire in a flat tab shape, but not limit to the shape shown in FIG. 11A.

The section 912*c* having semi circular bend portion, but not limit to the shape, can be in XY or XZ plane that is used for controlling high-band resonances (such as 5 GHz) by coupling. The section 912*d* is bended at the tip that can have lower effective resonance frequency. Further, it may reduce the total size of the helix element 91. The section 912*a* is a grounding connection extended from the first helix portion 911. Therefore, when a grounding element is used, such as the grounding element 14 shown in FIG. 2A, another covering portion (not shown) can be used to cover the section 912*a* for more securing with using the covering portion 141 to cover the first helix portion 911.

Figure 11A:
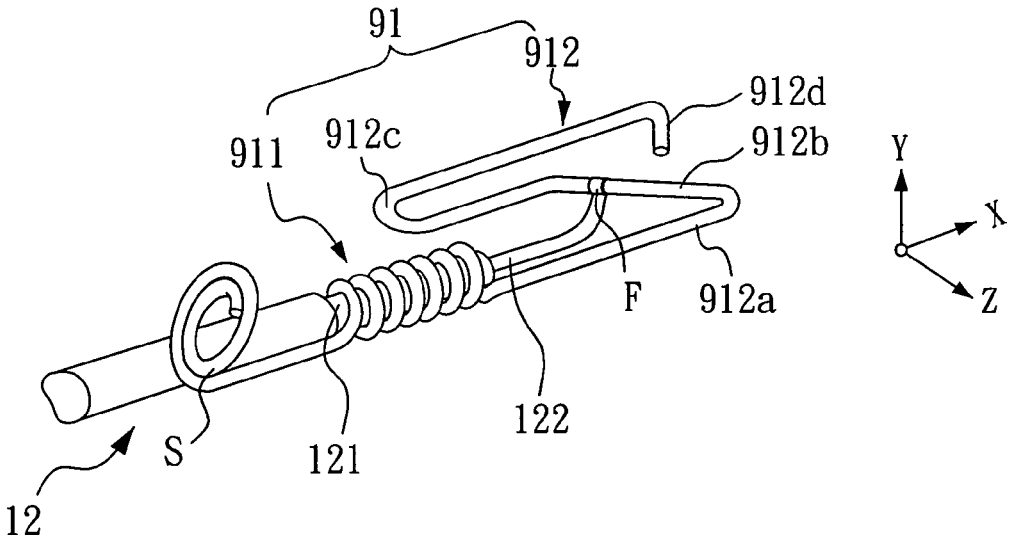
FIG. 11A is a perspective diagram of a helix element variation with different second helix portion.
Figure 11B:
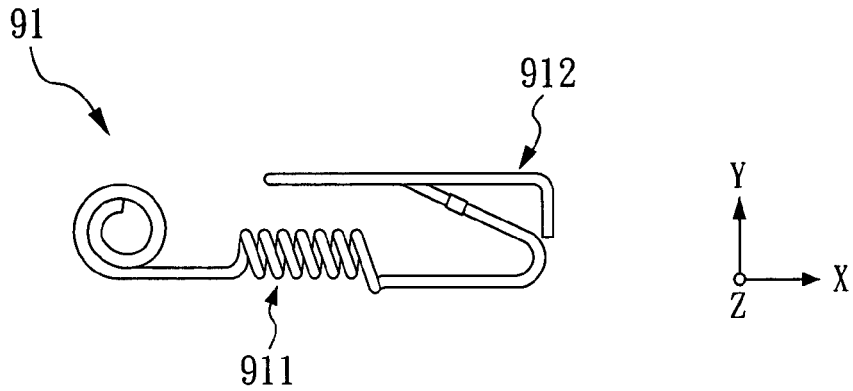
FIG. 11B is a top view of the FIG. 11A.
Figure 11C:
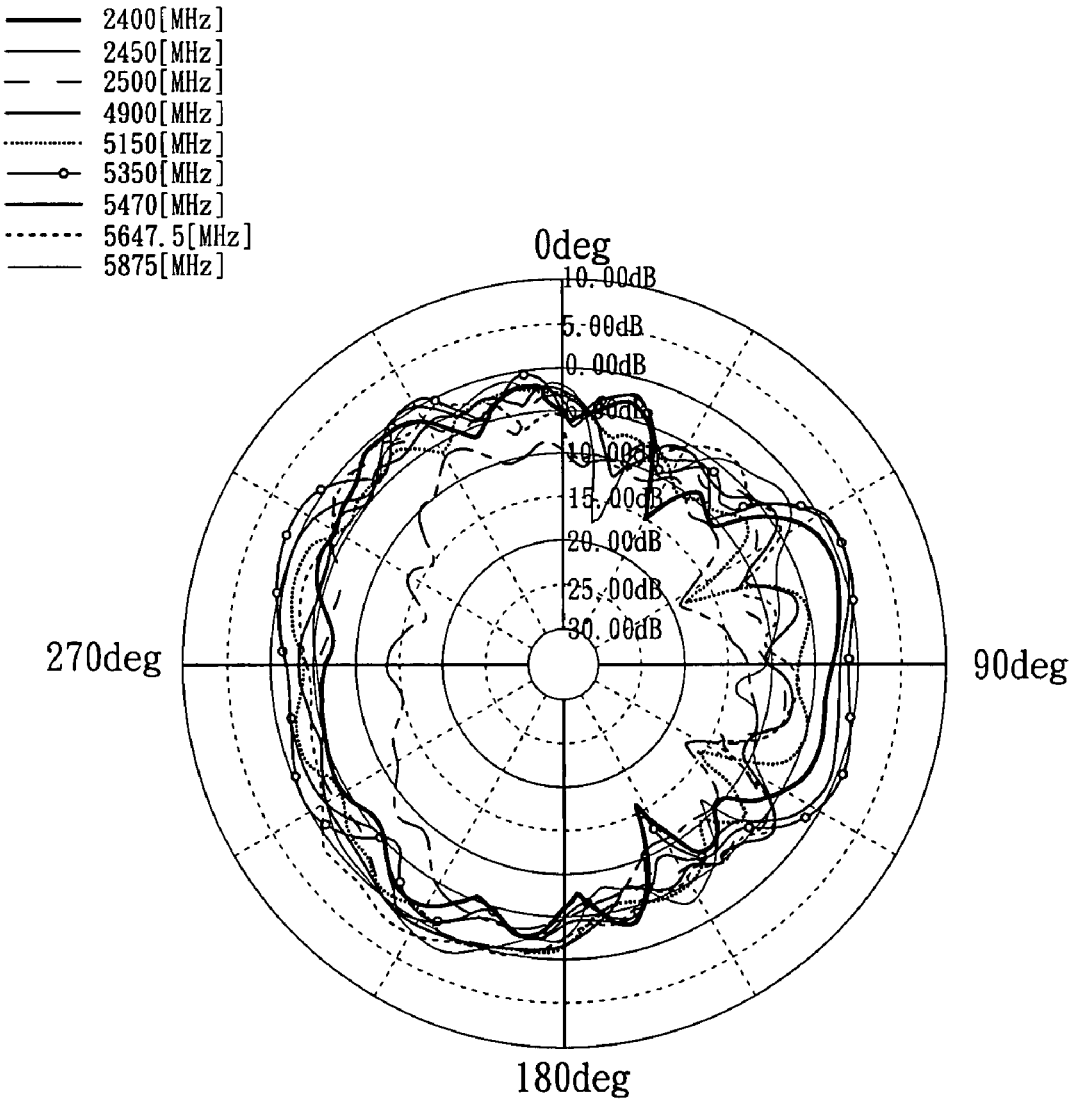
FIG. 11C is a radiation pattern with elevational plane (XY plane) according to multi-frequency antenna of FIG. 11A.
Figure 12:
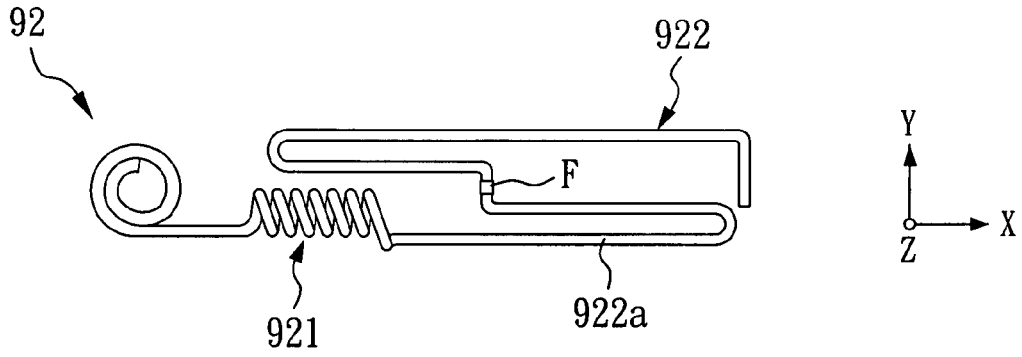
FIG. 12-FIGS. 15 and 16A-FIG. 16C are top views of different variations of helix elements.
Figure 13:
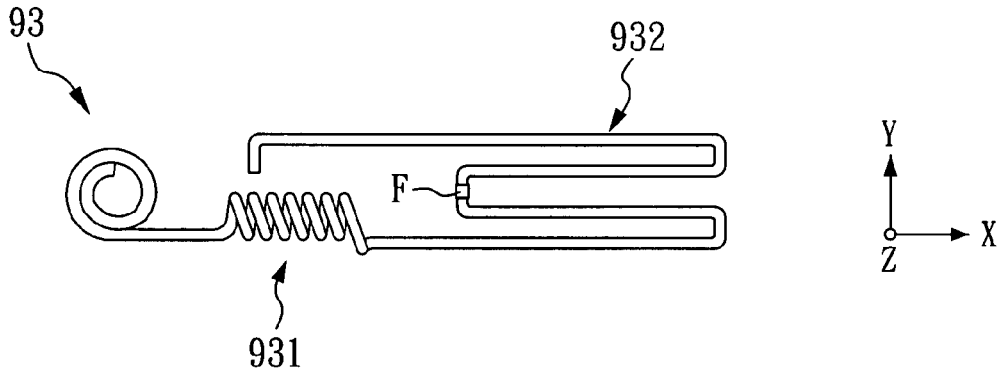
Figure 14:
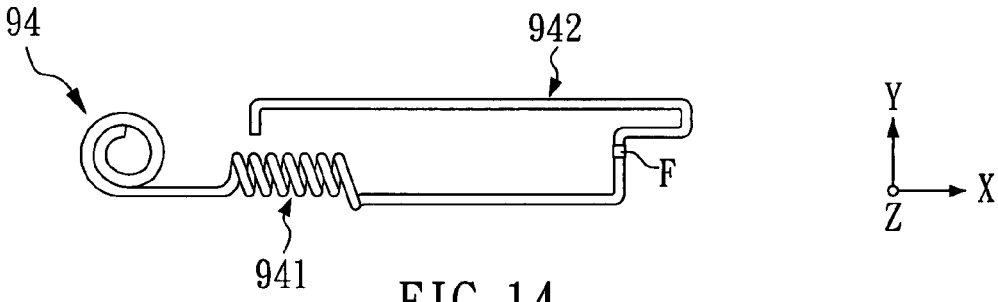

FIG. 11C is a radiation pattern with elevational plane (XY plane) according to multi-frequency antenna of FIG. 11A, which shows another radiation pattern comparing to the FIG. 3B.

Figure 15:
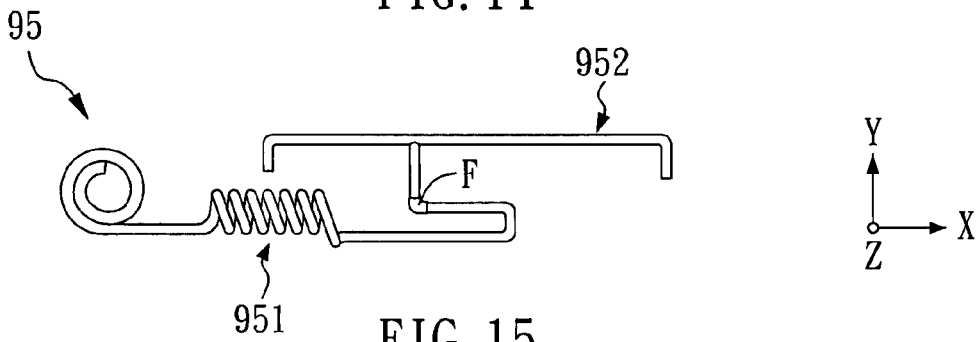
Figure 16A:
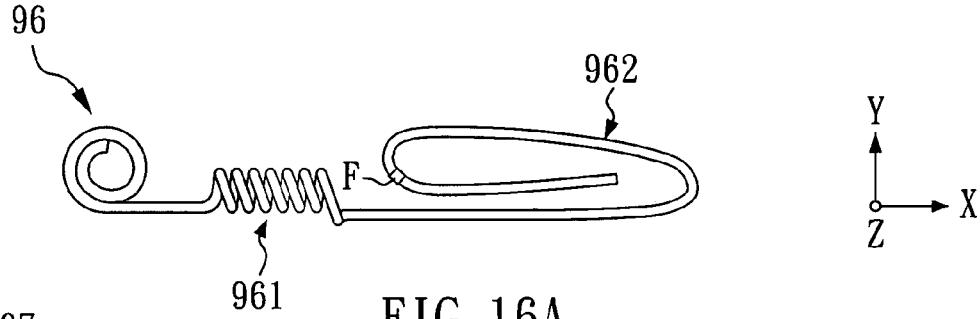
Figure 16B:
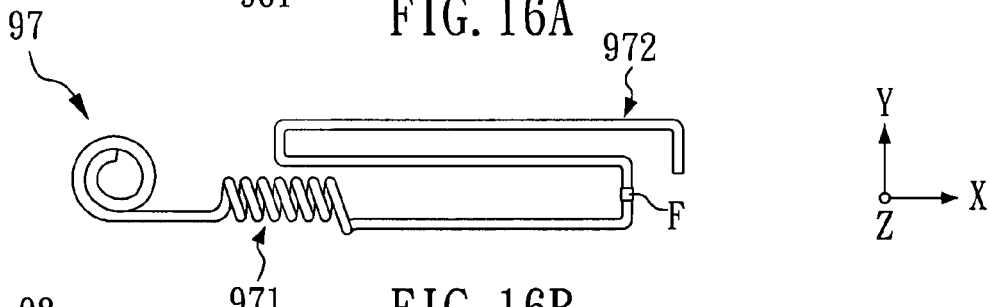
Figure 16C:
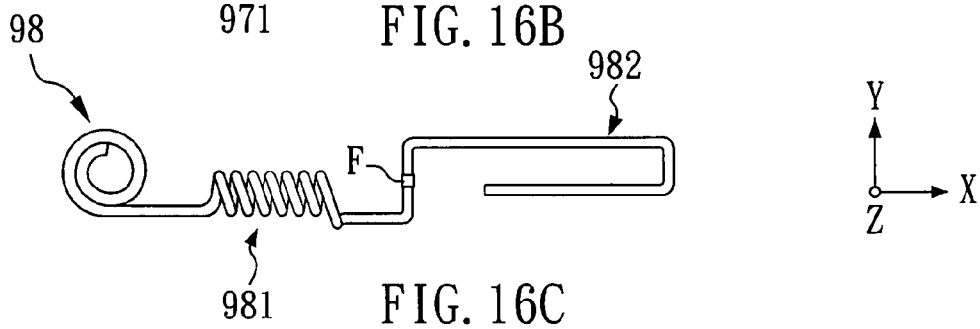

According to different frequencies, similarly, radiators 922, 932, 942, 952, 962, 972, 982, and 992 can be designed with different shape having the feeding point F designed therein. As shown in FIG. 15, the radiator 952 can be shaped with T-junction, which may obtain specific dual bands.

Figure 17:
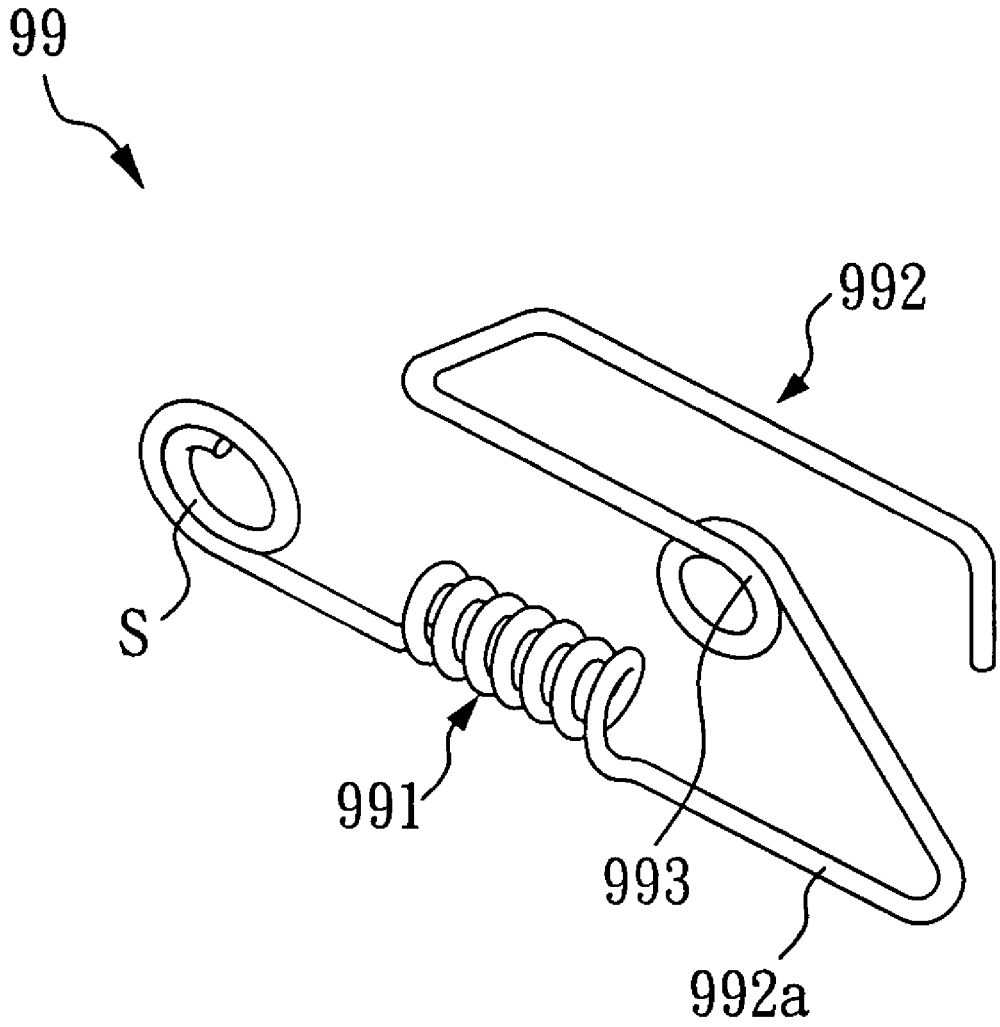
FIG. 17 is a perspective diagram of another helix element variation with different second helix portion comparing to FIG. 11A.
Figure 18:
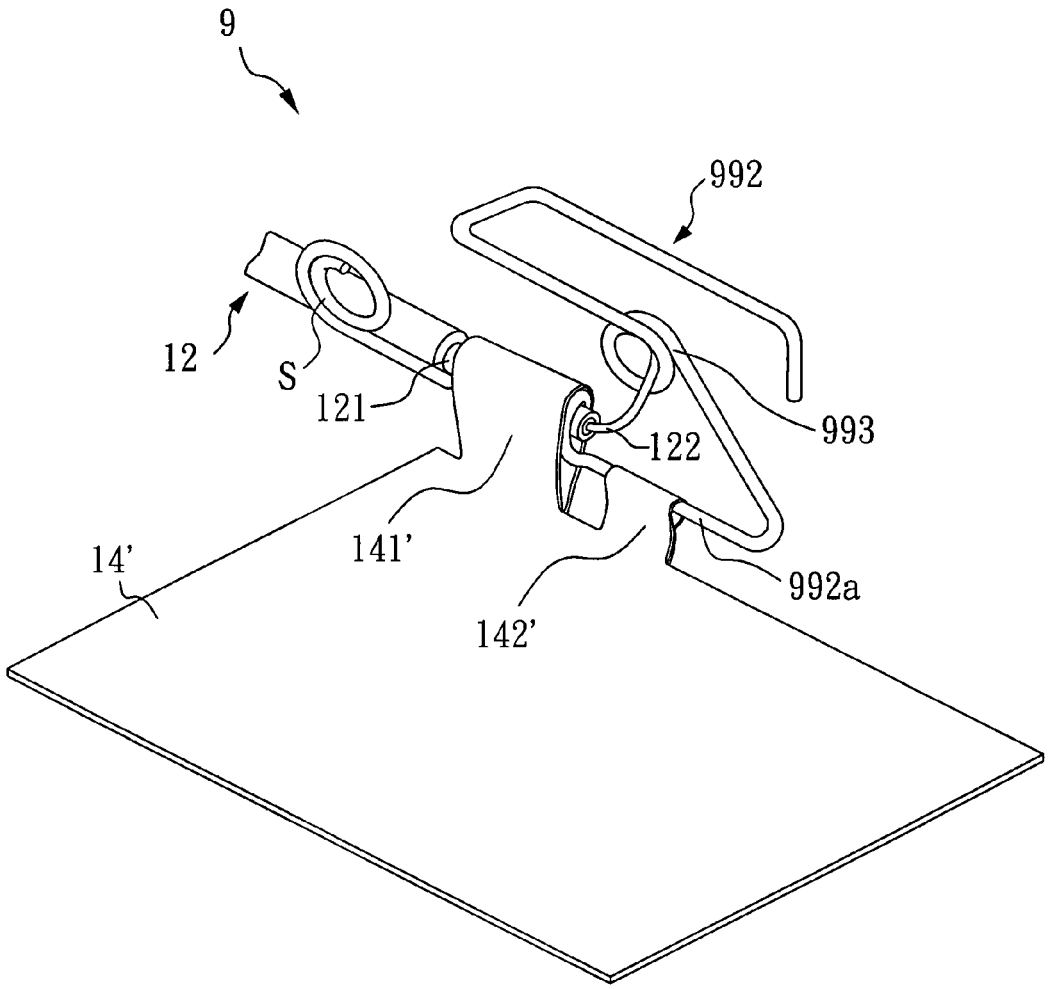
FIG. 18 is a perspective diagram of FIG. 17 with a grounding element.

Particularly, as shown in FIG. 17, the feeding point can be shaped in a loop 993 for easier processing to produce the helix element 99. In addition, referring to FIG. 18, a grounding element 14' comprising a covering portion 141' and a supporting portion 142' can be used in this embodiment. The covering portion 141' covers the first helix portion 991 and the supporting portion 142' covers one of the sections, for example, section 992*a* for supporting the helix element 99. Similarly, the helix element 99 may comprise a fixing portion S for fixing the multi-frequency antenna 9 into an electronic device (for example, as shown in FIG. 9).

The shape of the radiators 922, 932, 942, 952, 962, 972, 982, and 992 are used to illustrating the figures, which should not be used for limiting the present invention. Furthermore, the x-y-z coordinates are used to describe only, which should not be used to limit the present invention, either.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A multi-frequency antenna comprising:

a helix element comprising a first helix portion and a second helix portion adjacent to each other; and a coaxial cable disposed within the helix element, the coaxial cable comprising a grounding portion being covered by the first helix portion and a radiating portion disposed within the second helix portion;

wherein the grounding portion and the first helix portion are connected with each other, and the radiating portion and the second helix portion are separated with each other.

2. The multi-frequency antenna as claimed in claim 1, wherein the radiating portion comprises an isolating layer and a core being covered by the isolating layer.

3. The multi-frequency antenna as claimed in claim 2, wherein the grounding portion comprises a metal layer covering the isolating layer.

4. The multi-frequency antenna as claimed in claim 3 further comprising a grounding element comprising a covering portion covering the first helix portion that covers the metal layer so as to ground the grounding portion and the first helix portion simultaneously.

5. The multi-frequency antenna as claimed in claim 1 further comprising a fixing portion for fixing the multi-frequency antenna into an electronic device.

6. The multi-frequency antenna as claimed in claim 1 further comprising a dielectric portion disposed between at least a part of the radiating portion and at least a part of the second helix portion.

7. The multi-frequency antenna as claimed in claim 1, wherein the cross-section of the second helix portion is circular, square, oval, triangular, or polyhedron.

* * * * *